United States Patent [19]

Kohn

[11] 4,286,657

[45] Sep. 1, 1981

[54] ACTUATOR

[75] Inventor: Gary A. Kohn, Dallas, Tex.

[73] Assignee: Otis Engineering Corporation, Dallas, Tex.

[21] Appl. No.: 106,917

[22] Filed: Dec. 26, 1979

[51] Int. Cl.[3] ..... E21B 23/03

[52] U.S. Cl. ..... 166/117.5

[58] Field of Search ..... 166/117.5, 212, 122, 166/120

[56] References Cited

U.S. PATENT DOCUMENTS

| | | | |
|---|---|---|---|
| 2,624,412 | 1/1953 | Ragan | 166/120 |
| 3,318,385 | 5/1967 | Conrad | 166/122 |
| 4,002,203 | 6/1977 | Terral | 166/117.5 |

*Primary Examiner*—William F. Pate, III

*Attorney, Agent, or Firm*—Vinson & Elkins

[57] ABSTRACT

There is disclosed an actuator and a kickover tool including an actuator in which force is applied through the actuator by hydraulic means in which force due to the pressure medium in which the tool is submerged is substantially balanced across the seals of the pressure chambers and in which the force acting on the tool due to the pressure of the medium in which the tool is submerged remains balanced in the event any one of the seals becomes ineffective.

9 Claims, 2 Drawing Figures

ACTUATOR

Figure 1:
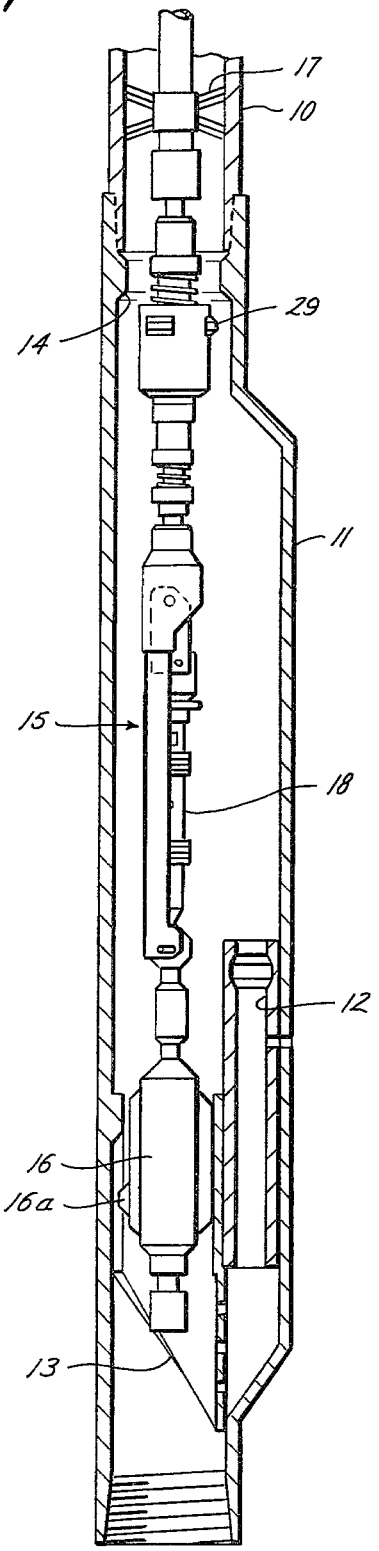

This invention relates to actuators and more particularly to actuators which may form a part of a kickover tool. This invention is an improvement on the actuator and kickover tool shown in the application of Ronald K. Churchman, Ser. No. 879,968, filed Feb. 21, 1978.

Tools of the so-called TFL (through the flow line) or pump down tools are designed to be utilized in wells such as those drilled in offshore waters in which the tool is lowered into the well and returned by pumping fluid through the flow line. Malfunction of such tools is a serious problem and particularly with offshore wells where it is very expensive if a tool malfunctions and the well tubing must be pulled to recover the tool. For this reason TFL tools are carefully designed and extensively tested to make them as failsafe as possible so that the tool can be readily recovered in the event of malfunction.

The kickover tool of the Churchman application provides the desirable feature of transmitting a force to effect the kickover operation through a column of hydraulic fluid. The tool is completely balanced and the pressure of the fluid in the well in which it is run has no effect on the tool so long as it operates properly. However, if certain seals on the tool do not function properly, there can possibly result an unbalanced force due to pressure of the fluid in the well on the tool which results in the premature actuation of the tool. While the failsafe features of the design should permit the tool to be retrieved from the well, it would be advantageous to provide the hydraulic actuation in such manner that failure of any of the seals would not result in an unbalanced condition which could conceivably cause premature actuation of the tool.

It is an object of this invention to provide an actuator and in particular an actuator which may form part of a kickover tool in which the actuation operation is effected by a column of hydraulic fluid and in which malfunction of any of the seals confining the hydraulic fluid will not result in an unbalance of forces on the tool due to the pressure of the well fluids in which the tool is immersed.

Another object is to provide an actuator and particularly an actuator which may be utilized as a part of a kickover tool in which a column of hydraulic fluid is moved by relative movement of a dog carrying sleeve in the body of the tool to result in reciprocation of an actuator and in which the pressure responsive areas of the pressure responsive parts are substantially equal so that the forces exerted by fluid in which the tool is submerged are balanced.

Another object is to provide an actuator and kickover tool as in the preceding object in which any deviation from the equal areas exposed to well fluids results in a force in a direction to move the actuator toward the nonactivating position, that is, with a kickover tool to a position in which the kickover arm is aligned with the body so that well fluids will not activate the tool.

Another object is to provide an actuator and a kickover tool including such actuator utilizing a column of hydraulic fluid to effect movement of the actuator in which failure of any of the seals confining the hydraulic fluid results in external fluid pressure being applied to the hydraulic fluid chamber so that there is no differential across any of the seals which provide a part of the hydraulic chamber.

Other objects, features and advantages of the invention will be apparent from the drawing, the specification and the claims.

Figure 2:
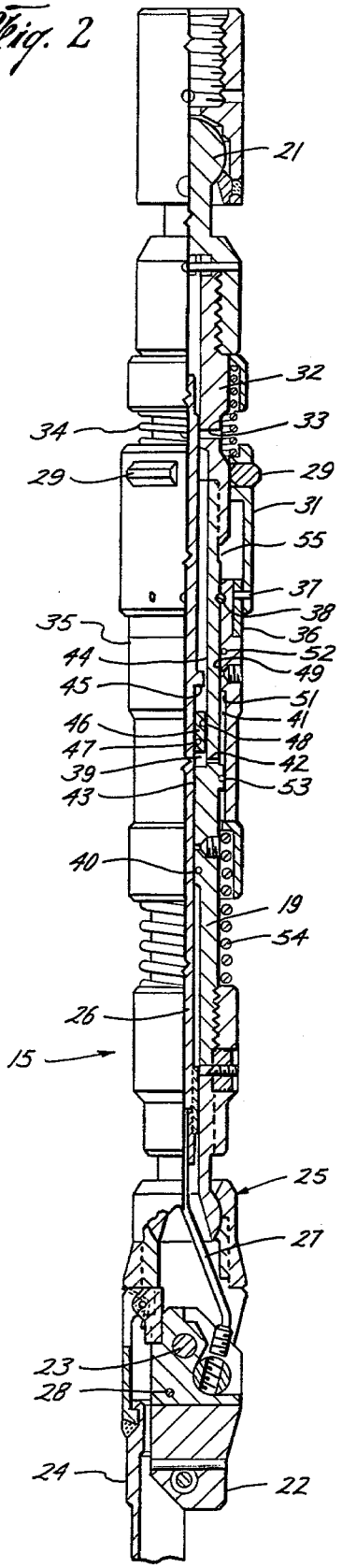

In the drawings wherein like numerals indicate like parts and wherein an illustrative embodiment of this invention is shown, FIG. 1 is a view in section through a tubing and side pocket mandrel illustrating schematically in elevation therein a tool constructed in accordance with this invention; and FIG. 2 is a view partially in elevation and partially in section of a fragment of the kickover tool shown in FIG. 1.

Referring first to FIG. 1, the tubing 10 which will be suspended in the usual petroleum producing well includes as a part thereof the side pocket mandrel 11. This mandrel has the usual valve receiving pocket 12 in which a valve or dummy may be placed. At the lower end of the mandrel there is provided a muleshoe 13 for orienting the tool. At the upper end of the mandrel a shoulder 14 is provided for activating the kickover tool.

The kickover tool indicated generally at 15 is made up in a train which includes the orienting equipment 16 and the locomotive or propelling piston 17. Several of these locomotives will be employed as a part of the train.

The orienter 16 forms no part of this invention, but serves to properly align the tool when it is pumped upwardly in the mandrel such that the pawl **16*a* engages the muleshoe 13 and causes the orienter and kickover tool to orient the valve 18 to be facing the bulge in the mandrel 11 in a position to be run into the receiver 12**.

The kickover tool 15 is provided with a body 19 which is secured to the remainder of the assembly by articulating joints such as shown at 21 so that the tool may traverse a radius in travelling through the tubing and particularly at the surface where the direction of travel normally changes between vertical and horizontal.

In order to carry a tool such as valve 18 (FIG. 1) the kickover tool is provided with an arm 22 which is pivoted at 23 to the tray 24. This tray 24 may be considered as forming a part of the tool body 19 as it is connected directly thereto by the articulating joint shown generally at 25.

In order to operate the kickover tool an actuator 26 is connected to the pivoted arm 22 by a cable 27. Relative upward movement of the actuator 26 rotates the tool carrying arm 22 from its aligned position as shown to a position extending approximately 90° thereto to position the valve 18 immediately above the pocket 12. After the valve is landed or retrieved in the usual manner, upward movement of the kickover tool will cause the arm 22 to engage the top bulge of the belly 11 of the mandrel resulting in shearing of pin 28 which permits a portion of the arm 22 which extends laterally out beyond the kickover tool to rotate to the in line position where it is preferably latched by a detent not shown. For a full disclosure of the details of this portion of the kickover tool, reference is made to the above identified application which is incorporated herein by reference in its entirety.

The kickover tool shown is of the type which is continuously pumped down into the hole until it passes the side pocket mandrel in which it is desired to operate at which time the dogs or lugs 29 engage the shoulder 14 on upward movement of the tool to initiate actuation of the kickover tool.

While being run in the hole the lug carrying sleeve 31 may move upwardly relative to the body 19 when the lugs engage any obstruction in the hole, such as the shoulder 14.

The upper end of the body is provided by an upper sub 32 having an external groove 33 therein. The spring 34 urges the dog carrying sleeve downwardly relative to the body but permits it to move upwardly as a shoulder in the tubing is engaged by the dogs 29. This upward movement permits the dogs to retract into the groove 33 and permits the tool to pass the obstruction. Upon reverse or upward movement the dogs 29 engage shoulder 14 and prevent further upward movement of the dog carrier 31 while the tool is actuated.

A first power piston is provided by the sleeve 35 mounted on the body 19. The dog carrier 31 through the ring 36 pinned to its lower extremity by shear pin 37 engages the sleeve 35. Thus, upon engagement of the dogs 29 with the shoulder 14, further upward pressure on the locomotive 17 will shear the shear pin 38 which up until this time has positioned the sleeve 35 on the body 19. Upon rupture of the shear pin 38 further upward movement of the body 19 relative to the sleeve 35 which is held stationary by the dogs 29 provides the activating power for moving the actuator 26 upwardly to pivot the tool carrying arm 22 out to its kickover position.

The force developed by the relative movement between body 19 and sleeve 35 is transmitted to the actuator 26 through a hydraulic connection. This hydraulic connection is provided by a pair of fluid chambers the first of which is shown at 39 and the second at 41. These two fluid chambers are interconnected by a small flowway 42. The two chambers are filled with hydraulic fluid and as the chamber 41 is decreased in volume the chamber 39 is increased in volume to lift the actuator 26.

Considering first chamber 39, the body is provided with a relatively small diameter cylindrical portion 43 and a relatively large diameter cylindrical portion 44. The actuator is provided with seals which engage these two cylindrical portions of the body to provide a pressure responsive surface defined by the difference in diameters of the seals engaging the different diameter sections of the body. The seal with cylinder 43 is provided by O-ring 40. Preferably, the actuator 26 has a flange 45 thereon and a floating piston 46 forms an operative portion of the actuator. The piston 46 has an internal O-ring 47 providing a sliding sealing engagement between the piston and the actuator. In like manner, a sliding sealing O-ring 48 provides a seal between the exterior of the piston and the large diameter cylinder 44. With the piston 46 engaging the flange 45 an increase in fluid within the chamber 39 causes the actuator 26 to rise.

The second fluid chamber is provided between the exterior of the body and the interior of the sleeve 35. The sleeve 35 has a small diameter section 49 and a larger diameter section 51. O-ring 52 seals between the relatively small diameter section of the sleeve with the body 19 and seal 53 seals between the relatively larger diameter section 51 of the sleeve and the body 19. The difference in diameter of the sections 49 and 51 provides a pressure responsive area exposed to the fluid chamber 41. Thus, when the sleeve 35 is held against upward movement and the body is moved upwardly, fluid is transferred from chamber 41 to chamber 39 forcing the actuator upwardly in the body to move the pivotal arm 22 out to kickover position.

In accordance with this invention each of seals 40, 47, 48, 52 and 53 is exposed on one side to pressure within the two chambers 39 and 41. On the sides opposite the pressure chamber each of these seals is exposed to the pressure medium surrounding the tool. Thus, if the tool is submerged in several thousand feet of liquid within a well the pressure of this liquid is effective on each of the O-rings 40, 47, 48, 52 and 53. As the piston 48 floats on the actuator 26 and the fluid within the two chambers is hydraulic the piston can float to a position in which the forces across the piston are equal and opposite and no differential is exerted across these O-ring seals.

In accordance with this invention, it is preferred that the pressure responsive area provided by the difference in seal diameter of seals 40 and 48 versus the difference in seal diameter of seals 52 and 53 be equal. If the two pressure responsive areas provided by the two chambers be equal then no force is exerted on the system which at great depth might prematurely activate the tool. Preferably, any departure from substantially equal pressure responsive areas would be one in which the difference in the area provided by O-rings 40 and 48 would be greater than the difference provided by O-rings 52 and 53. In this event any force exerted by liquid in which the tool is immersed would be moving the piston 46 downwardly, which has no effect on the actuator 26 and thus would not tend to have any effect on the pivot arm 22.

With all of the seals defining the two pressure chambers 39 and 41 exposed to ambient pressure conditions it will be appreciated that any failure of any of the seals permits well fluid to exert pressure on both of the chambers 39 and 41. Thus, the failure of one of the seals would not result in any unbalance of the system as the pressure within both of the chambers would be the same. For instance, if one of the seals were destroyed the pressure within both chambers 39 and 41 would be identical to the pressure exterior of the tool and the failure of a seal would not result in any unbalance of forces across the tool due to fluid pressure. The only result of the failure of one of the seals would be that the tool would be inoperative and the pivot arm could not be rotated out to its kickover position. The tool would not, however, as a result of a failure of a seal present any obstruction to returning the tool from the surface, thus resulting in a design in which loss of one of the seals of the two pressure chambers is failsafe.

After the kickover arm 22 has been rotated to its kickover position, the tool is lowered in the well in the usual manner to land or retrieve a valve or dummy. The tool is then lifted to retrieve it from the well and as noted above the portion of the arm 22 is returned to the in line position. While the tool is in its lowered position to land to retrieve a valve, the spring 54 which acts upwardly on the sleeve 35 is now free to move the sleeve to its upper position. Note that the spring 54 is stronger than the upper spring 34 and thus will move the sleeve 35 and the dog carrier 31 to an upper position in which the dogs 29 overlie the groove 33 and may retract into an out of the way position as the tool is withdrawn from the hole. A detent (not shown) holds arm 22 in kickover position and downward movement of piston 46 has no effect on actuator 26. Of course, if for any reason the dogs do prevent upward movement a large upward force may be applied to the locomotive, shearing pin 37 which will permit the dog carrier to move down over sleeve 35 and the dogs 29 to drop into the space.

In operation the kickover tool is run downwardly in the hole until it is below the mandrel 11. It is then reversed in direction and moved upwardly until the pawl 16a of the orienting sub 16 orients the tool into the proper kickover orientation shown in FIG. 1. After the tool is properly oriented the dogs 29 engage the shoulder 14 in the upper end of the side pocket mandrel. As force is applied the shear pin 38 is sheared releasing the sleeve 35 from the body 19. Upward movement of the body 19 relative to the sleeve 35 which is fixed against upward movement results in hydraulic fluid in the chamber 41 flowing into chamber 39 to force piston 46 into contact with shoulder 45 on the actuator and move the actuator 26 upwardly to rotate the arm 22 out into kickover position.

The tool is then lowered to land or retrieve a valve or dummy from receiver 12. As it is lowered the spring 54 overcomes spring 34 and moves the dog carrier 31 up to a position in which the dogs 29 reside over groove 33, thus permitting the tool to be raised and returned to the surface. As the pivotal arm 22 engages the top of the side pocket mandrel the portion of the arm 22 extending laterally outwardly is rotated about the pivot 23 shearing pin 28 and moving this extended portion of the arm to the aligned position. If for any reason the tool becomes hung in the hole the pin 37 will shear permitting the dog carrier 31 to move downwardly and the dogs 29 to fall into the groove 55 and permit the tool to be returned to the surface.

From the above it will be appreciated that the actuator section of the kickover tool shown could be used with any other tool in which it is desirable to have a hydraulic actuator move an actuator rod such as shown. In other words, other operations than rotating the kickover arm 22 could be carried out by the actuator 26, if desired.

The tool is rendered failsafe by way of loss of one of its seals by exposing each of the seals on one side to the fluid chambers and on the other side to the fluid exterior of the tool. A loss of one of the seals does not result in an effective differential area, that is, an area different from that with the seal intact which is exposed to pressure exterior of the tool. Any loss or leakage of pressure past a seal is effective on all of the seals and thus the force relationship in each direction across the sleeve 35 and the actuator piston 46 remains the same and if the tool will not actuate due to a faulty seal it may be removed from the well in a failsafe condition. By arranging the seals so that they are all exposed to external pressure, there is no opportunity for failure of one seal to result in an unbalance of forces which might operate the kickover tool prematurely and result in problems in operation or retrieval of the tool.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A tool comprising, a body, an actuator in telescoping relationship with and reciprocable relative to the body, a dog carrying sleeve in telescoping relationship with and reciprocable relative to the body, a first closed fluid chamber provided by spaced seals between the actuator and body, a second closed fluid chamber provided by spaced seals between the sleeve and body, a flowway between the two chambers transferring fluid between the two chambers with relative reciprocation of the body and sleeve, and hydraulic fluid filling the two chambers, all of said seals exposed to the exterior of the tool on their sides opposite the pressure chamber, reciprocation of said sleeve relative to said body resulting in reciprocation of said actuator in response to transfer of fluid between the two chambers.

2. The tool of claim 1 wherein the pressure responsive areas provided by the seals of each fluid chamber are approximately equal.

3. The tool of claims 1 or 2 wherein the actuator has a shoulder thereon and a floating piston between the actuator and body provides a portion of the first fluid chamber.

4. A kickover tool comprising, a body, a tool carrying arm pivotally carried by the body, an actuator reciprocal relative to the body for pivoting said arm, a dog carrying sleeve reciprocal relative to the body, a first fluid chamber provided by seals between the actuator and body, a second fluid chamber provided by seals between the sleeve and body, a flowway between the two chambers, and hydraulic fluid filling the two chambers, all of said seals exposed to the exterior of the tool on their sides opposite the pressure chamber.

5. The tool of claim 4 wherein the pressure responsive areas provided by the seals of each fluid chamber are approximately equal.

6. The tool of claims 4 or 5 wherein the actuator has a shoulder thereon and a floating piston between the actuator and body provides a portion of the first fluid chamber.

7. A kickover tool comprising, a body, a tool carrying arm pivotally carried by the body, an actuator for pivoting said arm, a cylinder in said body having first and second sections of different diameter, a sliding seal between said actuator and each of said first and second sections of said cylinder to provide a first pressure chamber, a sleeve slidably mounted on said body and having first and second sections of different diameter, a sliding seal between said body and each of said first and second sections of said sleeve to provide a second fluid chamber, a flowway between said two chambers, hydraulic fluid in said two chambers, all of said sliding sleeves exposed to the exterior of the tool on their sides opposite the fluid chambers, and means carried by said sliding sleeve for engaging a shoulder in a well and sliding said sleeve along said body to shift said actuator from a position in which said arm is aligned with said body to a position in which said arm is pivoted to a nonaligned position.

8. The kickover tool of claim 7 wherein the pressure responsive areas provided by the sliding seals of each fluid chamber are approximately equal.

9. The kickover tool of claims 7 or 8 wherein the actuator has a shoulder thereon and a floating piston on the actuator provides the sliding seal between the actuator and large diameter section of the cylinder.

* * * * *